US005599207A

United States Patent [19]

Lai

[11] Patent Number: 5,599,207

[45] Date of Patent: Feb. 4, 1997

[54] ELECTRICAL CONNECTOR WITH IMPROVED MOUNTING DEVICE

[76] Inventor: Chin T. Lai, 930 W. Maude Ave., Sunnyvale, Calif. 94086

[21] Appl. No.: 428,780

[22] Filed: Apr. 24, 1995

[51] Int. Cl.[6] ..... H01R 13/73

[52] U.S. Cl. ..... 439/567; 439/607; 439/357

[58] Field of Search ..... 439/567, 571, 439/572, 607, 350–358

[56] References Cited

U.S. PATENT DOCUMENTS 5,125,853 6/1992 Hashiguchi ..... 439/607

5,137,245 8/1992 Lee ..... 439/567

*Primary Examiner*—Gary F. Paumen

*Attorney, Agent, or Firm*—Jeing & Chang

[57] ABSTRACT

An electrical connector (50) includes an insulative housing (52) defining a central opening (58) having a plurality of passageways (60) on two side for receiving a plurality of corresponding contacts (62) therein. A shield (74) is attached to the front surface (67) of the housing (52). A pair of L-shaped brackets (64) are formed adjacent two opposite ends of the housing (52) each having a horizontal slot (66) on the underside for securely receiving a corresponding mounting boardlock (90) therein. The boardlock (90) includes a horizontal portion (92), an engaging section (94) upward extending at the front end, and a pair of mounting legs (96) downward extending at the rear end. A securement tab (98) is positioned at the tip of the rear end of the boardlock (90). A pair of latches (84) are inserted into the corresponding vertical slots (72) of the housing (52) with hooks (89) projecting externally for releasably latching the complementary connector, and with tangs (87, 88) engaging the housing for securing the latches (84) in the housing (52) wherein the housing (52) includes a pair of vertical walls (73), in which the vertical slots (72) are positioned. An independent post (102) is communicatively positioned beside each vertical slot (72) and spaced from the projection section (56) of the housing (52) by a space (S) in the lengthwise direction along the housing (52) to provide capability of deflection thereabout for permission of possible tilting insertion of the latch (84) into the vertical slot (72) in the housing (52).

11 Claims, 5 Drawing Sheets

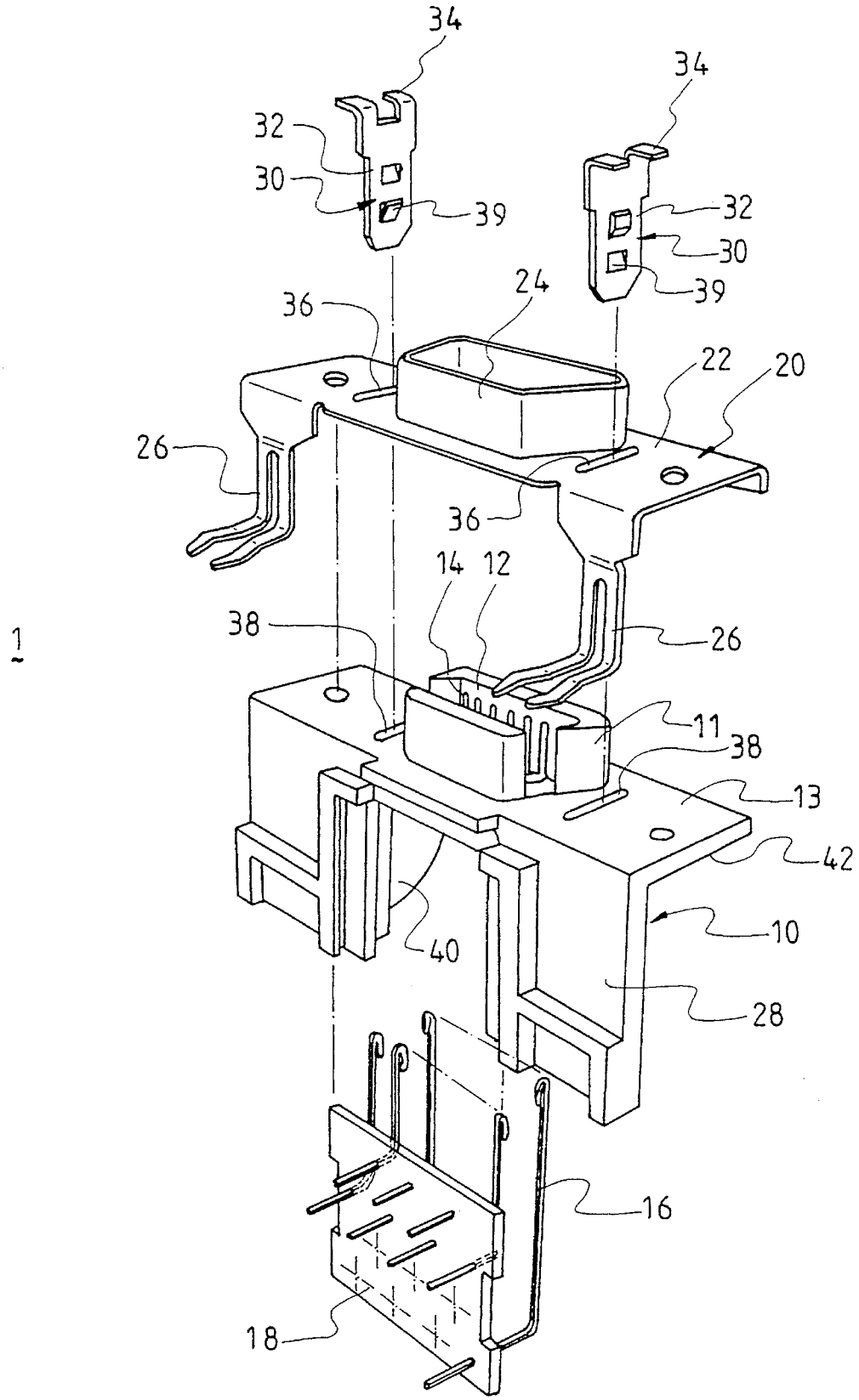
FIG,1 (PRIOR ART)

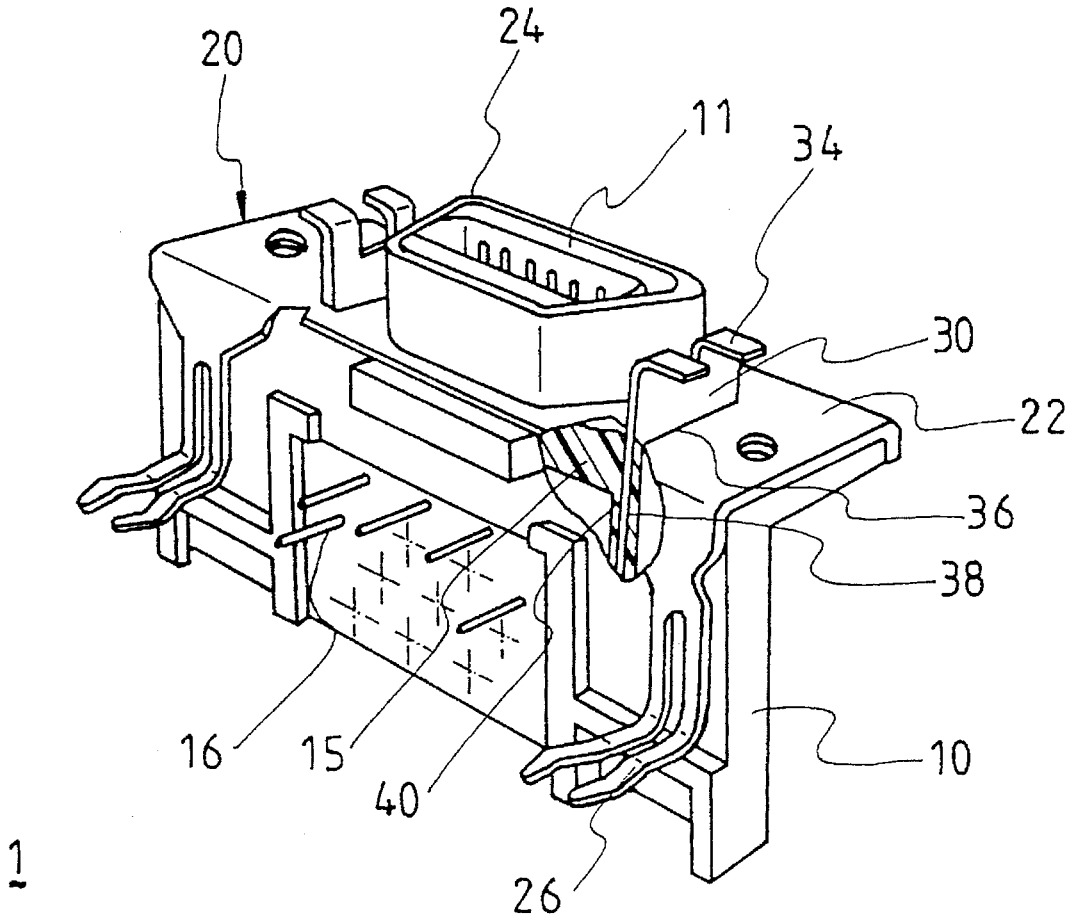
FIG,1A (PRIOR ART)

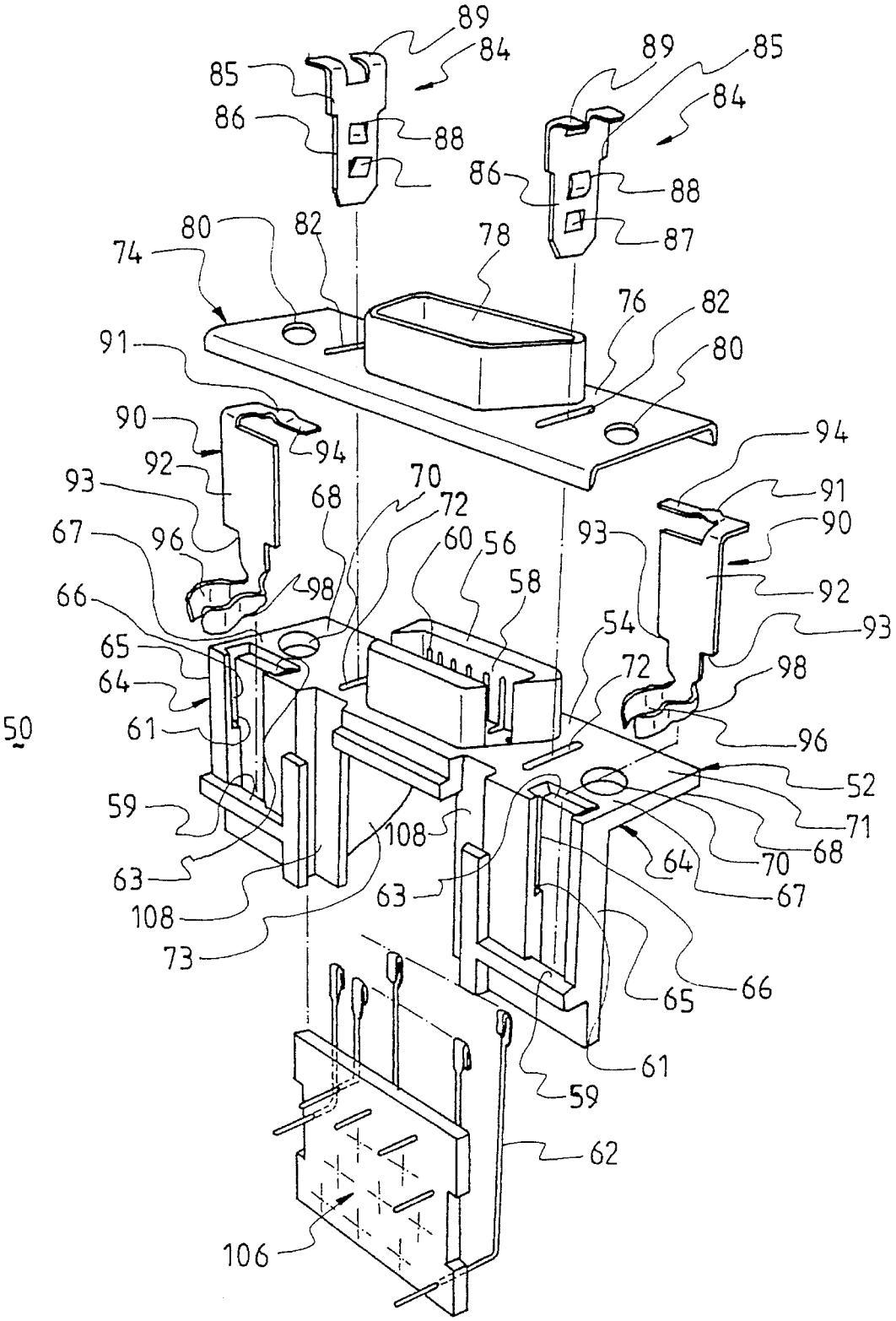
FIG,2

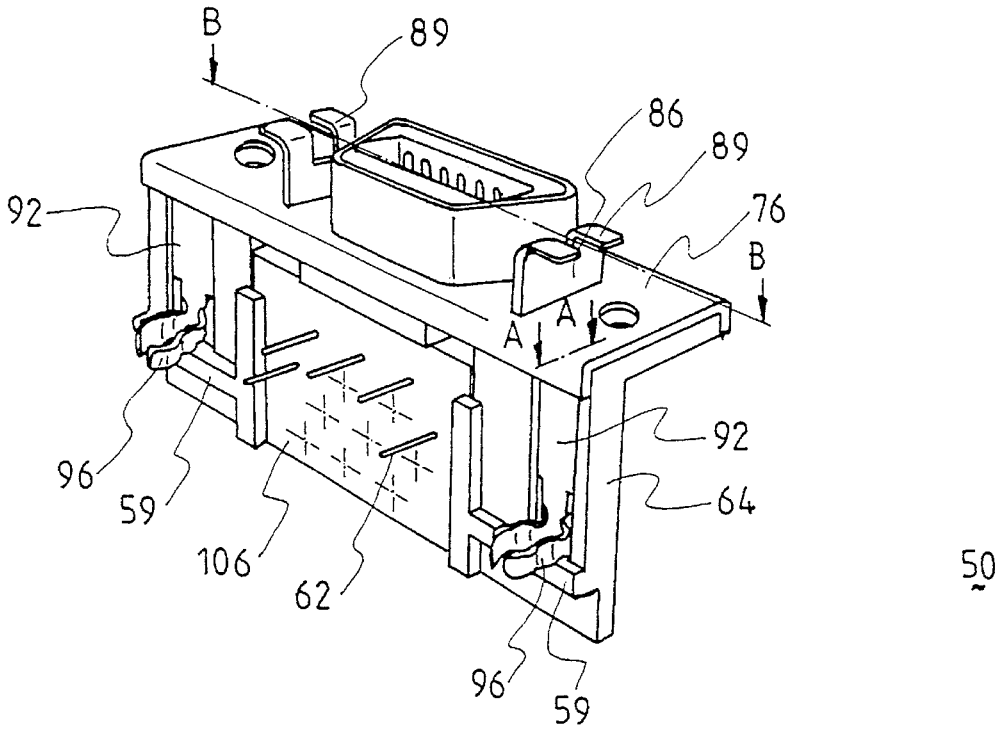
FIG,3
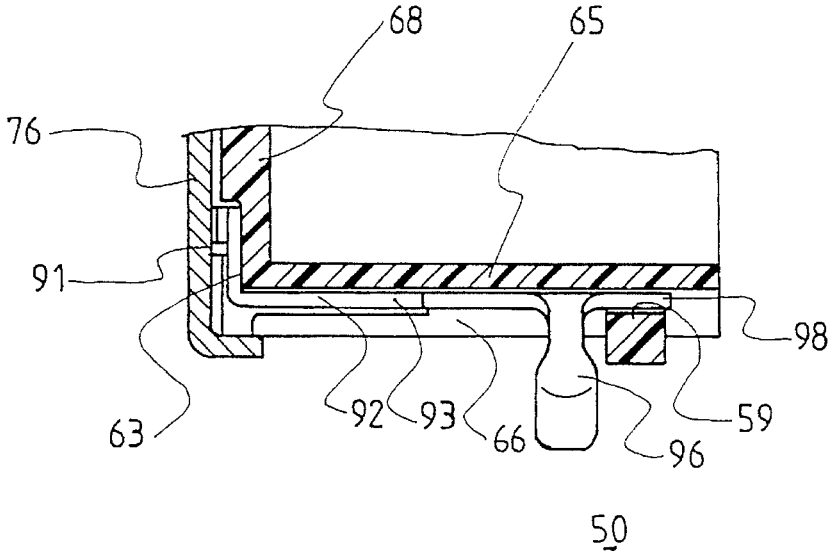
FIG,4

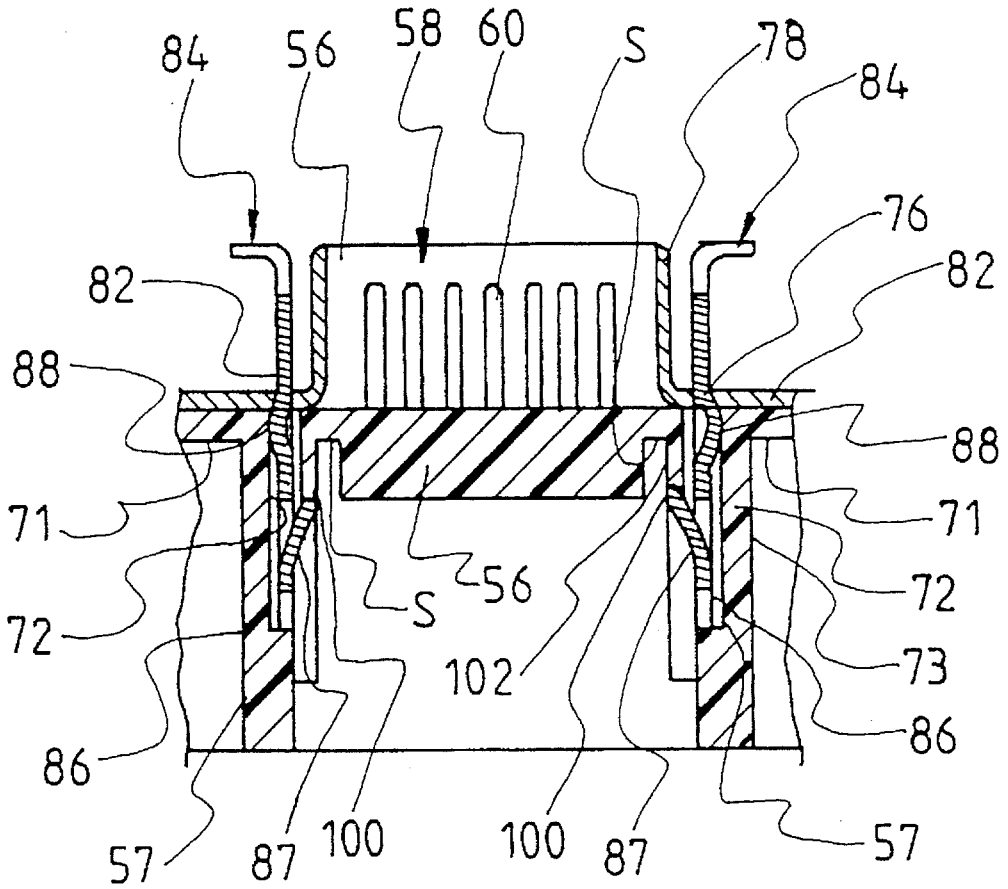
FIG, 5

ELECTRICAL CONNECTOR WITH IMPROVED MOUNTING DEVICE

BACKGROUND OF THE INVENTION

1. Field of The Invention

The invention relates to electrical connectors, especially to connectors each having separate improved mounting devices.

2. The Prior Art

As shown FIG. 1, the prior art connector 1 includes an insulative housing 10 having a forward projecting section 11 in the front portion with a central opening 12 therein for receiving a complementary connector (not shown). The housing 10 further includes two rows of passageways 14 communicatively positioned adjacent to the opening 12 for receiving a plurality of corresponding contacts 16 therein wherein such contacts 16 project into the opening 12 for engagement with the corresponding contacts of the complementary connector. A spacer plate 18 is disposed in the rear portion of the housing 10 for aligning the tails of the contacts 16 in the vertical direction. A metal shield 20 attached to the front portion of the housing 10, includes a base section 22 adapted to cover the front surface 13 of the housing 10, and a tubular section 24 adapted to cover the projecting section 11 of the housing 10 wherein two pair of right angle mounting legs 26 integrally extend from the bottom edge thereof adjacent two ends of the base section 22, so that such pairs of mounting legs 26 positioned approximate the undersurface 28 of the housing 10, may extend downward for securement with the board on which the housing 10 is mounted. A pair of latches 30 each generally formed of a tag-like plate 32 with a hook 34 at the end, are inserted into the housing 10 from the front through the apertures 36 in the shield 20 and into the cavities 38 wherein such pair of cavities 38 are positioned with a corresponding pair of vertical walls 40 (only one shown) extending rearward from the back surface 42 of housing 10 and generally between the central opening 12 and the outermost ends of the housing 10 in the lengthwise direction.

The conventional connector has disadvantages as follows. First, the mounting legs 26 extend integrally from the base section 22 of the shield 20. Because the shield 20 is formed by stamping from a metal sheet, the shield 20 with its integral mounting legs 26 which has a large dimension when it is in an initial extended unformed manner, wastes too much material for the raw metal sheet. Secondly, the tubular section 24 of the shield 20 is formed by drawing method so that the property of the shield is not expected to be too stiff to be drawn, but the characteristic of the mounting legs is desired to own enough stiffness for securement consideration on the board. Therefore, there is a contradiction to select the material of such integral shield and mounting legs, thus sacrificing the performance and the manufacturing of either part (i.e., the shield itself or the mounting leg). Third, there is no proper fixation means for use with the mounting legs with regard to the housing 10 so that the mounting leg 26 may be tilted by external impact during shipping or handling, thus increasing defective.

Additionally, the latch 30 is forcibly inserted into the cavity 38 in the vertical wall 40 of the housing 10 and retained therein by means of the lateral projecting tangs 39 engaging the housing 10. Referring to FIG. 1(A), because the vertical wall 40 does substantially extend integrally with the main body 15 of the housing 10 in the lengthwise direction thereof, it is stiff around the portions which define the cavity 38. Understandably, sometimes the latch 30 may not be so accurately inserted into the cavity 38 in a vertical state, and thus such tilting insertion of the latch 30 may jeopardize the structure of the housing 10 around such cavity 38 because the latch 30 is made of a great strength material and the housing portions surrounding the cavity 38 does not provide any buffer means to compromise such misaligned insertion of the latch 30. The damaged structure of the cavity 30 may hurt its original retention function to the latch 30.

Therefore, an object of the invention is to provide a connector having an improved mounting leg and latch mechanism wherein the mounting leg has a good character and proper retention and saves the raw material in manufacturing, and the latch incorporates a buffer structure in the housing for allowing somewhat tilting insertion of the latch during assembling.

SUMMARY OF THE INVENTION

According to an aspect of the invention, an electrical connector includes an insulative housing defining a central opening having a plurality of passageways on two side for receiving a plurality of corresponding contacts therein. A shield is attached to the front surface of the housing. A pair of L-shaped brackets are formed adjacent two opposite ends of the housing each having a slot on the underside for securely receiving a corresponding mounting boardlock therein. The boardlock includes a horizontal portion, an engaging section upward extending at the front end, and a pair of mounting legs downward extending at the rear end. A securement tab is positioned at the tip of the rear end of the boardlock.

A pair of latches are inserted into the corresponding vertical slots of the housing with hooks projecting externally for releasably latching the complementary connector, and with tangs engaging the housing for securing the latches in the housing wherein the housing includes a pair of vertical walls in which the vertical slots are position. An independent post is communicatively positioned beside each vertical slot and spaced from the main body portion of the housing by a space in the lengthwise direction along the housing to provide capability of deflection thereabout for permission of possible tilting insertion of the latch into the vertical slot in the housing.

BRIEF DESCRIPTION OF THE DRAWINGS

FIG. 1 is an exploded perspective view of the prior art connector.

FIG. 1(A) is an assembled partially cut-away perspective view of the prior art connector of FIG. 1 to show the inner structure around the cavity of the vertical wall.

FIG. 2 is an exploded perspective view of an electrical connector according to the invention.

FIG. 3 is an assembled perspective view of the connector of FIG. 2.

FIG. 4 is a fragmentary cross-section view cut-away along line A—A of the connector of FIG. 2 to show the relation among the boardlock, the housing and the shield.

FIG. 5 is a fragmentary cross-sectional view cut-away along line B—B of the connector FIG. 2 without contacts and spacer therein to show the relation among the latch, the housing and the shield.

DETAILED DESCRIPTION OF THE PREFERRED EMBODIMENT

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiment by those skilled in the art without departing from the true spirit and scope of the invention as defined by appended claims.

It will be noted here that for a better understanding, most of like components are designated by like reference numerals throughout the various figures in the embodiment. It is noted that even though the connector shown in FIGS. 2 and 3 is facing upward for easy illustration, the true application of such connector is of a right angle type which is adapted to be mate with the complementary connector in the horizontal direction. Therefore, the defined portions of the connector related to the direction is based on the true application status, not according to the direction in the drawing itself. Attention is now directed to FIG. 2, an electrical connector 50 includes an insulative housing 52 having a plate base 54 with a forward projecting section 56 enclosing a central opening 58. Two rows of passageways 60 are positioned beside the central opening 58 for receiving the corresponding number of contacts 62 therein whereby the front tips of the contacts 62 may project into the opening 58.

A pair of L-shaped brackets 64 are integrally formed adjacent two opposite ends of the housing. Each L-shaped bracket 64 includes a horizontal section 65 and vertical section 68 wherein the horizontal section 66 includes a horizontal slot 66 extending, from the front surface 67, on the underside thereof, and the vertical section 68 includes a screw hole 70 adjacent to the end of the housing 52 and a vertical slot 72, aside the projecting section 56, extending rearward into a vertical wall 73 which extends rearward from a back surface 71 of the plate base 54 of the housing 52 and also integrally with the L-shaped bracket 64.

A shield 74 adapted to be attached to the front surface 67 of the housing 52, includes a base section 76 and a projecting tubular section 78 in compliance with the front configuration of the housing 50. A pair of screw holes 80 are positioned adjacent to two opposite ends thereof for alignment with the screw holes 70 in the housing 50, and a pair of apertures 82 are positioned approximate the tubular section 78 and are aligned with the vertical slot 72 in the housing 52.

A pair of latches 84 are positioned at two sides of the projecting section 56 (tubular section 78) of the housing 52 (the shield 74) wherein each latch 84 generally includes a tag-like main body 86 having a first and a second tangs 87, 88 thereon, and a hook section 89 at the front tip.

A pair of boardlocks 90 are positionably attached to the corresponding L-shaped brackets 64, respectively. Each boardlock 90 includes a horizontal portion 92, an engagement section 94 upward extending at the front end, and a pair of mounting legs 96 oppositely downward extending from two side edges thereof. At the rear end of the horizontal portion 92, a securement tab 98 between such pair of mounting legs 96 rearward projects.

Referring to FIGS. 2–5, when assembled, each boardlock 90 is loaded to the housing 52 by the horizontal portion 92 moving along and in the horizontal slot 66 in the horizontal section 65 of the L-shaped bracket 64 until the shoulders 93 of the horizontal portion 92 of the boardlock 90 confronts the steps 61 in the mid-length of the horizontal slot 66. In this situation, the securement tab 98 is appropriately embedded within the end of the horizontal slot 66 and abuts against a restraint bar 59 on the undersurface of the horizontal section 65 of the L-shaped bracket 64. Such engagement between the securement tab 98 and the restraint bar 59 is very close to the mounting legs 96, thus providing efficient restriction of the mounting legs 96 in the vertical direction. Therefore, the mounting legs 96 of the boardlocks 90 can have a fixed relation to the housing 52. As a result, the engagement section 94 of the boardlock 90 is generally positioned within the recess 63 in the vertical section 68 and such recess 63 is substantially positioned at the front end of the horizontal slot 65. A bump 91 of the engagement section 94 somewhat projects out of the front surface 67.

Successively, the shield 74 is attached onto the front surface 67 of the housing 52 wherein through drawing process to form internally threaded flanges (not shown) around the screw holes 80 in the shield 74, the shield 74 may be slightly retained to the housing 52 by means of such drawn flange embedded within the screw holes 70 in the housing 52. The bump 91 of the engagement section 94 of the boardlock 90 substantially abuts against the base section 76 of the shield 74. This mechanical engagement results in electrical coupling between the boardlock 90 and the shield 74 for grounding. Finally, (referring to FIG. 5) each latches 84 is inserted into the corresponding aperture 82 in the shield 74 and the corresponding slot 72 in the housing 52 whereby the main body 86 of the latch 84 moves along and in the slot 72 until the rear end of the latch 84 confronts the step 57 of the housing 52 which is positioned at the end of the slot 72.

Under this situation, the first tang 87 is sprung out to have its distal end engage the rear end 100 of an independent post 102 wherein such post 102 is substantially independently spaced from the vertical wall 73 and the projection section 56. It can be seen that there is a space S between the post 102 and the projection section 56. It should be understood that in comparison with the prior art connector as shown in FIGS. 1 and 2, the connector 50 of the invention provides better resilience of the post 102 for compromising a relatively large amount of tilting insertion of the latch 84. The engagement between the first tang 87 and the post 102 may prevent such latch 84 from being back drawn from the housing 52.

Also, under this situation, the second tang 88 is sprung out to have its distal end somewhat engage the back surface of the base section 76 of the shield 74 about the aperture 82 in the shield 74 for preventing the latch 84 from back moving with regard to the shield 74. Moreover, the shoulders 85 (FIG. 2) of each latch 84 may press against the front surface of the base section 76 of the shield 74 around such aperture 82, thus providing a main fixation function for combining the shield 74 to the housing 52. Therefore, the housing 52, the boardlock 90, the shield 74 and the latch 84 are in position fastened with each other, and the whole connector 50 is assembled as shown in FIG. 3.

Referring to FIGS. 2 and 3, it can be appreciated that to align the tails of the contacts 62 with the holes in the PC board (not shown) on which the connector 50 is seated, a spacer 106 may be optionally attached to the housing 50 via a pair of opposite channels 108 respectively positioned adjacent two opposite vertical walls 73 whereby each tail of the contact 62 can extend through the corresponding holes in the spacer 106.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. An electrical connector comprising:

an insulative housing having a plate base and a forward projecting section;

a plurality of contacts positioned within the projecting section;

a pair of L-shaped brackets integrally extending with the plate base adjacent two opposite ends thereof, each bracket including a horizontal section having a horizontal slot on an undersurface thereof receiving a discrete boardlock therein, each bracket further including a vertical section having a screw hole adjacent to the end of the housing; and a shield having a base section and a tubular section to attachably cover a front surface of the housing; wherein each boardlock includes a horizontal portion, an engagement section upwardly extending at a front end thereof, mounting means extending downward at a rear end thereof, and a securement tab positioned at a rear tip of the horizontal portion whereby a restraint bar is positioned on the undersurface of the horizontal section of the L-shaped bracket to cooperate with said securement tab for efficiently limiting downward movement of said mounting means.

2. The electrical connector as defined in claim 1, wherein a recess is provided adjacent a front end of the horizontal slot for receiving the engagement section of the boardlock therein, said engagement section of the boardlock further includes a bump for resiliently abutting against the base section of the shield.

3. The electrical connector as defined in claim 1, wherein said mounting means of the boardlock includes a pair of mounting legs extending downward from two side edges of the horizontal portion of the boardlock.

4. The electrical connector as defined in claim 3, wherein a pair of shoulders are provided on two sides of the horizontal portion of the boardlock to cooperate with corresponding steps in the horizontal slot for limiting back movement of the boardlock.

5. The electrical connector as defined in claim 1, wherein said connector further includes a pair of latches positioned within a pair of vertical slots of said pair of L-shaped brackets, each of said vertical slots extending into a vertical wall which extends rearward from a back surface of the plate base, each of said latches including a main body having at least a first tang thereon and a hook section at a front end whereby an independent post is provided on the housing for each latch to incorporate the corresponding first tang for preventing the latch from moving back after being assembled.

6. A method of assembling an electrical connector which includes an insulative housing having two L-shaped brackets integrally extending on two opposite ends thereof, each bracket including a horizontal section having a horizontal slot on an undersurface thereof for receiving a corresponding boardlock therein, and a vertical section having a vertical slot for receiving a latch therein, each boardlock including a horizontal portion, an engagement section upward extending at a front end and at least a mount leg extending downward at a rear end, a shield covering a front surface of the housing and having a pair of apertures for alignment with the vertical slots in the brackets, the assembling steps comprising:

attaching said two boardlocks to the corresponding brackets of the housing via the horizontal portions of the boardlocks respectively moving along and in the horizontal slots in the horizontal sections of the brackets;

attaching the shield to the housing wherein the shield substantially engages the engagement sections of the boardlocks for not only electrical grounding consideration but also mechanically preventing said boardlocks from moving rearwardly; and said two latches inserted into the corresponding vertical slots whereby shoulder means on the latches may abut against the shield for efficiently fastening the shield to the housing, and whereby an independent resilient post is positioned adjacent each of said vertical slots for engagement with said first tang of the latch so that minor tilting insertion of said latch with regard to the housing is substantially allowed because of resilience of said independent post.

7. The method as defined in claim 6, wherein each said boardlock further includes a securement tab positioned adjacent to said mounting leg, and each of said bracket further includes restraint bar on the undersurface thereof for restraining downward movement of the mounting leg of the boardlock.

8. The method as defined in claim 6, wherein each boardlock further includes shoulders on two sides of the horizontal portion to cooperate with steps of the brackets in the horizontal slot for preventing further rearward movement of the boardlock in the horizontal slot during assembling.

9. An electrical connector comprising:

an insulative housing having a plate base and a forward projecting section;

a plurality of contacts positioned within the projecting section;

a pair of L-shaped brackets integrally extending with the plate base adjacent two opposite ends thereon, each bracket including a horizontal section for attaching a boardlock thereto, each bracket further including a vertical section having a screw hole adjacent to the end of the housing and having a vertical slot adjacent said projecting section for receiving a latch therein, said vertical slot extending rearwardly into a vertical wall which extends rearwardly from a back surface of the housing and integrally with the L-shaped bracket;

a shield having a base section and a tubular section to attachably cover a front surface of the housing;

each boardlock including at least a horizontal portion and mounting means extending downwardly adjacent a rear end thereof; and each latch including a main body having at least a first tang thereon and a hook section at a front end whereby an independent post is provided on the housing for each latch to engage the first tang of the latch for preventing the latch from moving forwardly after assembly.

10. The electrical connector as defined in claim 9, wherein each boardlock further includes an engagement section upwardly extending from a front end of the horizontal portion for engagement with the shield and a securement tab positioned at the rear end of said horizontal portion for engagement with a restraint bar on an undersurface of the bracket of the housing.

11. The electrical connector as defined in claim 10, wherein each boardlock further includes shoulder on two sides of the horizontal portion to confront steps in a horizontal slot which is positioned in the horizontal section of the corresponding bracket.

* * * * *